US005659663A

United States Patent [19]

Lin

[11] Patent Number: 5,659,663

[45] Date of Patent: Aug. 19, 1997

[54] INTEGRATED AUTOMATICALLY SYNCHRONIZED SPEECH/MELODY SYNTHESIZER WITH PROGRAMMABLE MIXING CAPABILITY

[75] Inventor: James J. Y. Lin, Hsinchu, Taiwan

[73] Assignee: Winbond Electronics Corp., Hsinchu, Taiwan

[21] Appl. No.: 420,665

[22] Filed: Apr. 12, 1995

[51] Int. Cl.[6] ..... G10L 5/02

[52] U.S. Cl. ..... 395/2.67; 395/2.69; 395/2.76; 395/2.79; 395/2.7

[58] Field of Search ..... 395/2.67, 2.69, 395/2.76, 2.79, 2.7; 381/51, 52, 53

[56] References Cited

U.S. PATENT DOCUMENTS 4,527,274 7/1985 Gaynor ..... 381/51
4,542,524 9/1985 Laine ..... 381/53
4,613,985 9/1986 Hashimoto et al. ..... 381/51
4,669,121 5/1987 Shigehara et al. ..... 381/51

*Primary Examiner*—Allen R. MacDonald
*Assistant Examiner*—Robert Sax
*Attorney, Agent, or Firm*—Fish & Richardson P.C.

[57] ABSTRACT

A synthesizer includes a controller which generates an address signal in response to a trigger code corresponding to a sequence of a synthesis of a plurality of basic speech sections; a memory for storing sets of data corresponding to the sequence of the synthesis of the speech sections; a tone counter and a speech/melody generator which receives the data from the memory. In response to control signals from the controller and a tone control signal from the tone counter the speech/melody generator provides synthesized speech or melody mixing with each other in a selective manner.

8 Claims, 11 Drawing Sheets

INTEGRATED AUTOMATICALLY SYNCHRONIZED SPEECH/MELODY SYNTHESIZER WITH PROGRAMMABLE MIXING CAPABILITY

TECHNICAL FIELD OF INVENTION

The invention relates to a speech synthesizer, and, in particular, to a speech synthesizer with melody output.

BACKGROUND OF INVENTION

A speech synthesizer, a melody generator or a combination of melodies and synthesized speech is useful in a variety of commercial equipments.

A conventional melody generator, as shown typically in FIG. 1, includes a START ROM 11, TEMPO COUNTER 13, RHYTHM COUNTER 15, ADDRESS COUNTER 17, MELODY ROM 19, ENVELOPE COUNTER 12, TONE COUNTER 14, D/A CONVERTER 16, MIXER 18 and oscillator (OSC) 10, and generates accessed melody 181 at the MIXER 18.

In response to different trigger signals TG1, . . . TGn, a corresponding melody in MELODY ROM 19 is selected. The START ROM 11 stores the tempo and start address of each melody in a data structure shown in FIG. 2. The start address 111 selected by the trigger signal TGn are received by the ADDRESS COUNTER 17, which is clocked by a clock signal CLK, and sends address signal 171 to access the contents of the MELODY ROM 19 incrementally.

The MELODY ROM 19 stores information, such as rhythm, tie and tone, of each note in the synthesis sequence corresponding to the selected melody in a data structure shown in FIG. 3.

The tempo, representing the speed of the melody, is decided when selection is made to the START ROM 11 by TGn signal, while the rhythm of each note, representing the specific relative duration of the note under the specified tempo, is decided by the value of the RHYTHM in MELODY ROM 19.

The tempo represents the speed of the melody and the TEMPO COUNTER 13 is pre-set by the tempo signal 113. The TEMPO COUNTER 13 receives a basic clock 101 from the OSC 10 and divides the frequency of the basic clock 101 in response to the value of the tempo signal 113. The greater the value of tempo signal 113, the smaller the frequency of the system clock 131 output from the TEMPO COUNTER 13. When the frequency of the system clock 131 is low, the frequency of the output signal 151 from the RHYTHM COUNTER 15 is low and, as a result, the speed of the melody output 181 or the tempo from mixer is thereby slowed down.

The rhythm information 191 is output from MELODY ROM 19 to pre-set the RHYTHM COUNTER 15. When the specified relative duration, represented by the value of the rhythm information 191, of a note comes to an end, the output signal 151 of RHYTHM COUNTER 15 changes state once which increments the ADDRESS COUNTER 17 by one. Therefore, each consecutive note of a melody is accessed sequentially until an END information in the MELODY ROM 19 is reached.

The tone information 193 from MELODY ROM 19 is received by TONE COUNTER 14, which is clocked by CLK2 signal, and generates OUT signal shown in FIG. 5. In FIG. 5, each square wave signal with a frequency corresponds to one tone value stored in MELODY ROM 19.

The TIE information 192 from MELODY ROM 19 is received by ENVELOPE COUNTER 12, which is clocked by CLK1 signal, and generates a digital ENV signal. The digital ENV signal is fed to the D/A converter 16, and the output of the D/A converter 16, as shown in FIG. 4, is then mixed with OUT signal by MIXER 18 to result in the melody output 181 shown in FIG. 6. In the example of FIG. 4, the third note is tied to the fourth note indicated by TIE=1 while others being not tied to its immediate following note indicated by TIE=0.

It is obvious, in order to generate melody, the circuit shown in FIG. 1 is complicated and is expensive.

One typical speech synthesizer, as shown FIG. 7, includes CONTROL CIRCUIT 71, ROM 73, SPEECH GENERATOR 75, D/A converter 77 and oscillator 79.

As shown in FIG. 7 and FIG. 8, the ROM 73 has three different segments, START ADDR 731, GO COMMAND 732 and SPEECH DATA 733. The data structures of each segment and the access path are shown in FIG. 8 by 81, 82, and 83 respectively.

The START ADDR 731 has the same function as START ROM 11 of the melody generator of FIG. 1, and stores attribute information and a start address of each speech code TGn which is input to CONTROL CIRCUIT 71. GO COMMAND 732 stores data attribute, a data length and a data address for each basic speech section accessed in the synthesis sequence corresponding to a speech code. The data attributes within GO COMMAND 732 may include speech playback frequency, length of bytes and LED control signals in accordance with a well-known conventional approach. In a well known manner, the value of the playback frequency is used to control the operation speed of the speech generator 75 and thereby control the playback speed of the output 771. The SPEECH DATA 733 stores data representing basic speech (sound) section for synthesis purpose.

As an example, suppose a speech equation TG: HEAD+2*SOUND1+SOUND2+TAIL is programmed into the ROM 73. The start address within the START ADDR 731 stores the address value, assuming it is 00, for accessing this speech equation TG. The location of address 00 of the GO COMMAND 732 stores the data attribute, data length and data address for the first sound section HEAD. The location of the following address 01 stores the data attribute, data length and data address for the second sound section SOUND1. The location of the further following address 02 stores the data attribute, data length and data address for the third sound section SOUND2, etc.. On the other hand, the SPEECH DATA 733 stores respectively the data required for synthesizing the sound section HEAD, SOUND 1, SOUND2 and TAIL respectively. Furthermore, the SPEECH DATA 733 may store data representing silence, or, in different term, no speech being generated.

The output of the D/A converter 77 corresponding to the speech equation TG: HEAD+2*SOUND1+SOUND2+TAIL may have a shape shown in FIG. 9. The HEAD enables the output signal rising from zero to an intermediate value which biases the external amplifier transistor in an operating range. When the TAIL is encountered, the output signal decreases to the initial zero state. However, the above described speech synthesizer in FIG. 7 is applicable to the production of synthesized speech only.

There are several different types of approaches, according to the conventional arts, to produce melody and speech by a single integrated circuit.

Referring to one conventional approach of FIG. 10, a melody circuit 102 and a speech circuit 103 are coupled to each other back-to-back in a single monolithic chip 100. However, the operation of the individual circuits is independent from each other and therefore no substantial benefit results from this conventional approach. Furthermore, it is difficult, if not impossible, to synchronize the melody circuit 102 with the speech circuit 103 in this configuration.

Referring to another conventional approach of FIG. 11, the OSC circuit 114 and the control circuit 112 are common to speech circuit 115 and melody circuit 117 in a single monolithic chip 110. No further saving of common circuits are achieved in this configuration and synchronization between speech circuit 115 and melody circuit 117 still is not readily implemented.

Referring to still another conventional approach shown in FIG. 12, the MELODY ROM 120 and SPEECH ROM 122 are integrated together in a single monolithic chip 118 and are distinguishable by the labels M, S. The advantages of the design reside in the easy synchronization between the melody circuit 125 and the speech circuit 127, and the interchangeable operation of the melody circuit 125 and speech circuit 127. However, this configuration does not allow output of speech and melody at the same time, since both functions use a common DATA ROM including MELODY ROM 120 and SPEECH ROM 122. Only one melody data or a speech data can be accessed at any time.

U.S. Pat. No. 4,613,985 discloses a synthesizer with the function of developing melodies. The synthesizer includes a memory storing the sequence of synthesis for each word and melody, a synthesized word generator providing audible indications of respective speech and a melody generator providing melodies in the form of a synthesized sound. The selected melodies are audibly delivered by fetching their associated sequence of synthesis from the memory.

SUMMARY OF THE INVENTION

In light of the conventional arts, it is therefore a first object of the invention to provide a speech synthesizer to generate a desired melody together with a synthesized speech.

The further object of the invention is to associate attributes of speech to represent the attributes of both speech and the melody, e.g. tempo, rhythm, envelope.

In particular, the data length of the accessed sound section is used to control the rhythm of a melody generated, the playback frequency of the data attribute is used to control the tempo of the melody generated and the speech waveform obtained by the speech synthesizer is used as the envelope of the melody.

The synthesizer provided comprises a controller, a memory, a tone counter and speech/melody generator.

The controller, generates a plurality of control signals, and, in response to a trigger code, generates an address signal.

The memory stores data representing sequences of the basic speech section and the corresponding attribute thereof for the trigger code.

The tone counter, in response to a clock signal and a tone data from the memory, generates a tone control signal.

The speech/melody generator, receiving the data from the memory, and in response to the control signals from controller and tone control signal, provides synthesized sounds mixing with melody in a selective manner.

DETAILED DESCRIPTION OF THE PREFERRED EMBODIMENT OF THE INVENTION

Figure 13:
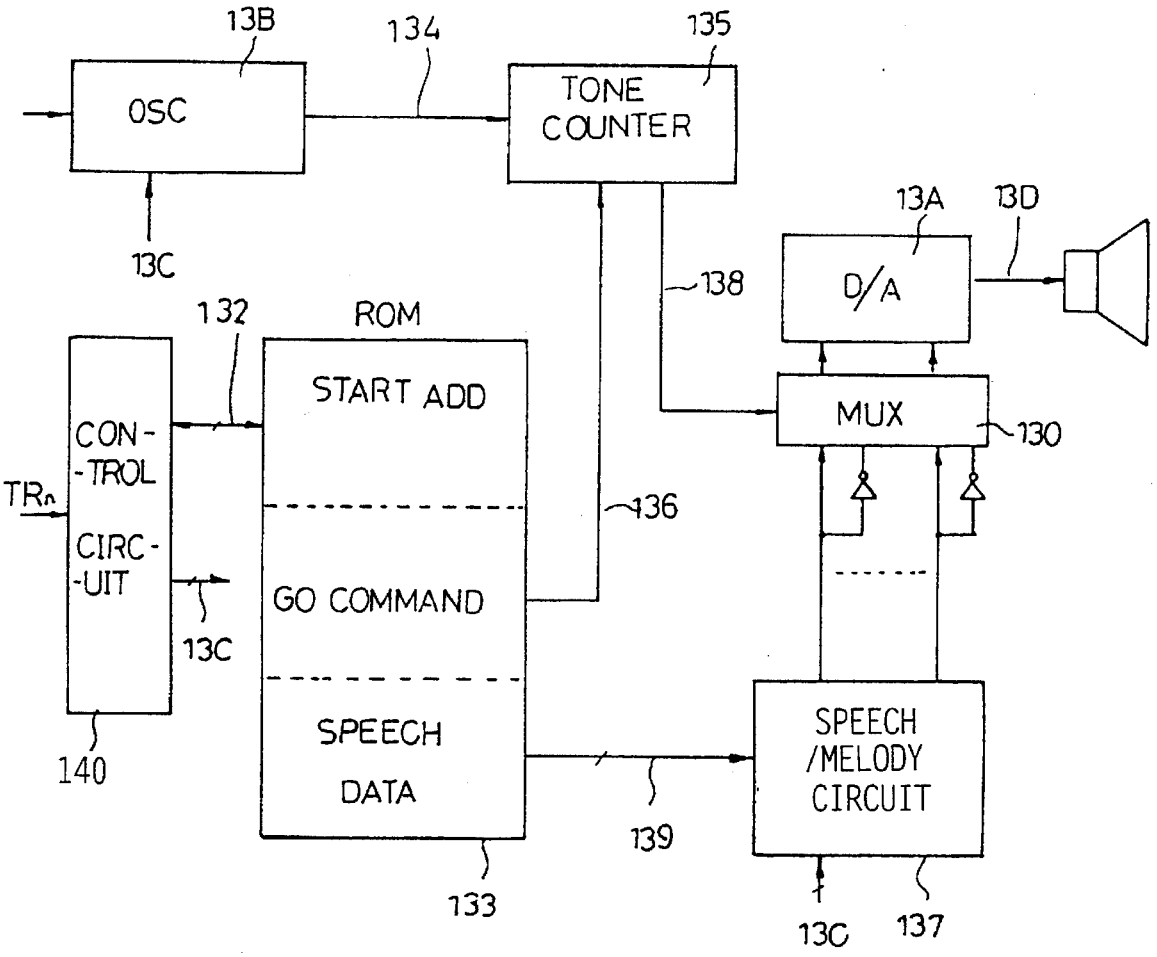
FIG. 13 shows one preferred embodiment of the invention.

Referring to FIG. 13, the invention provided comprises a controller 131, a memory 133, a tone counter 135 and a speech/melody generator 137.

The controller 140 generates a plurality of control signals 13C and, in response to a trigger code TRn, generates the address signal 132 for accessing the start address of the corresponding sequence of the synthesis within the memory 133. The control signals 13C are used to activate other circuits, e.g. OSC 13B, the speech/melody generator 137 and other associated circuits in a well known manner.

The memory 133 stores data representing sequences of speech synthesis for each trigger code TRn and the corresponding attribute thereof, e.g. the data attribute, tone value, data length and data address of the basic speech sections designated in the speech-melody equation, all of which will be detailed described hereinafter.

The tone counter 135, in response to a clock signal 134 and a tone data 136 from the memory 133, generates a tone control signal 138.

The speech/melody generator 137 receives the data 139 from the memory 133, and in response to the control signals 13C from controller 140 and tone control signal 138, provides synthesized speech or melody mixing with each other in a selective the form of synthesized sounds.

Figure 14:
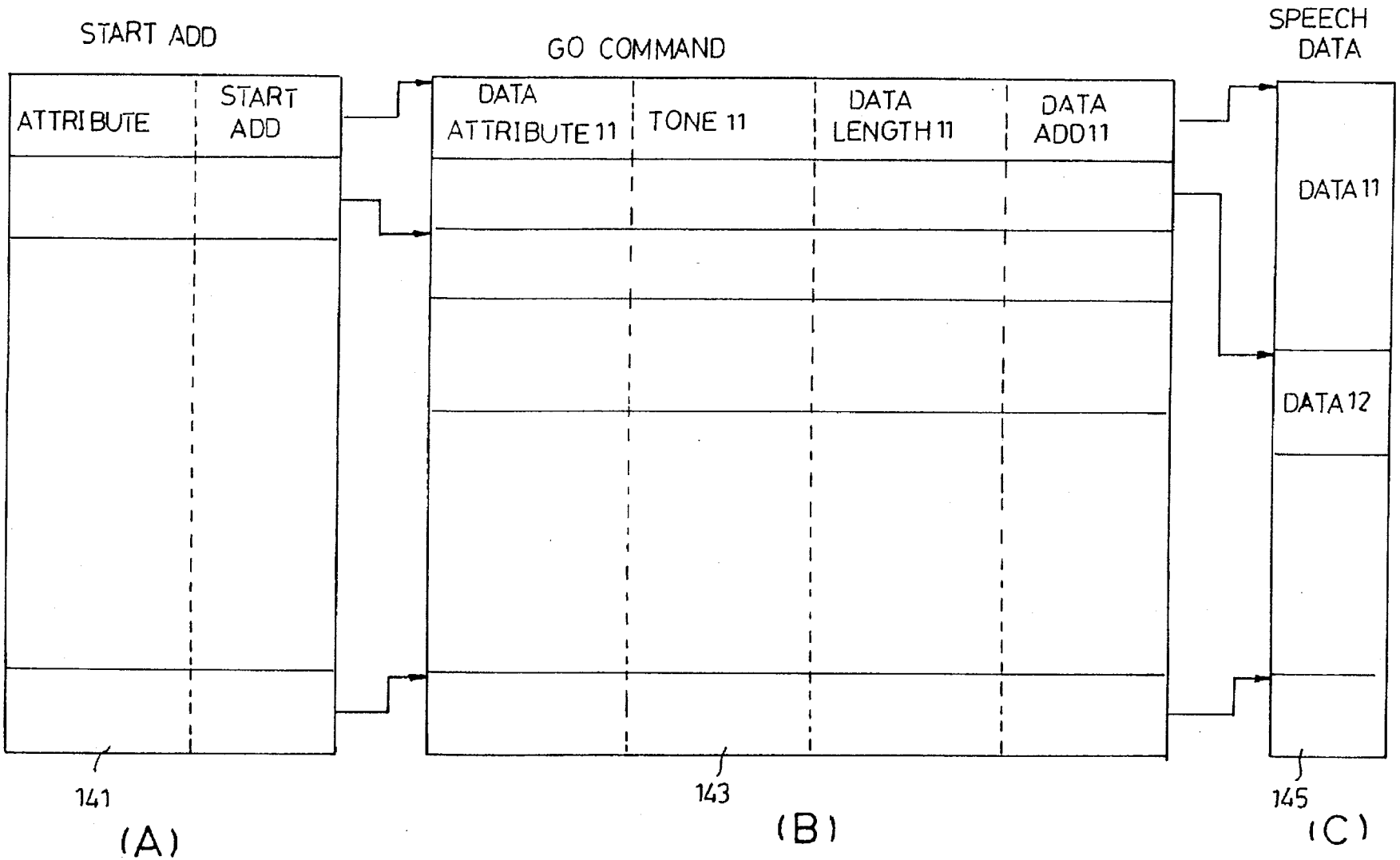
FIGS. 14(A), 14(B) and 14(C) show the data structures of the START ROM, GO COMMAND and SPEECH DATA, respectively, of FIG. 13.

As shown in FIGS. 14(A), 14(B) and 14(C), the memory 133 is in form of Read Only Memory (ROM) which has three different segments, START ADDR 141, GO COMMAND 143 and SPEECH DATA 145. The data structures of each segment and the access path are shown in FIGS. 14(A), 14(B) and 14(C), respectively.

Figure 1:
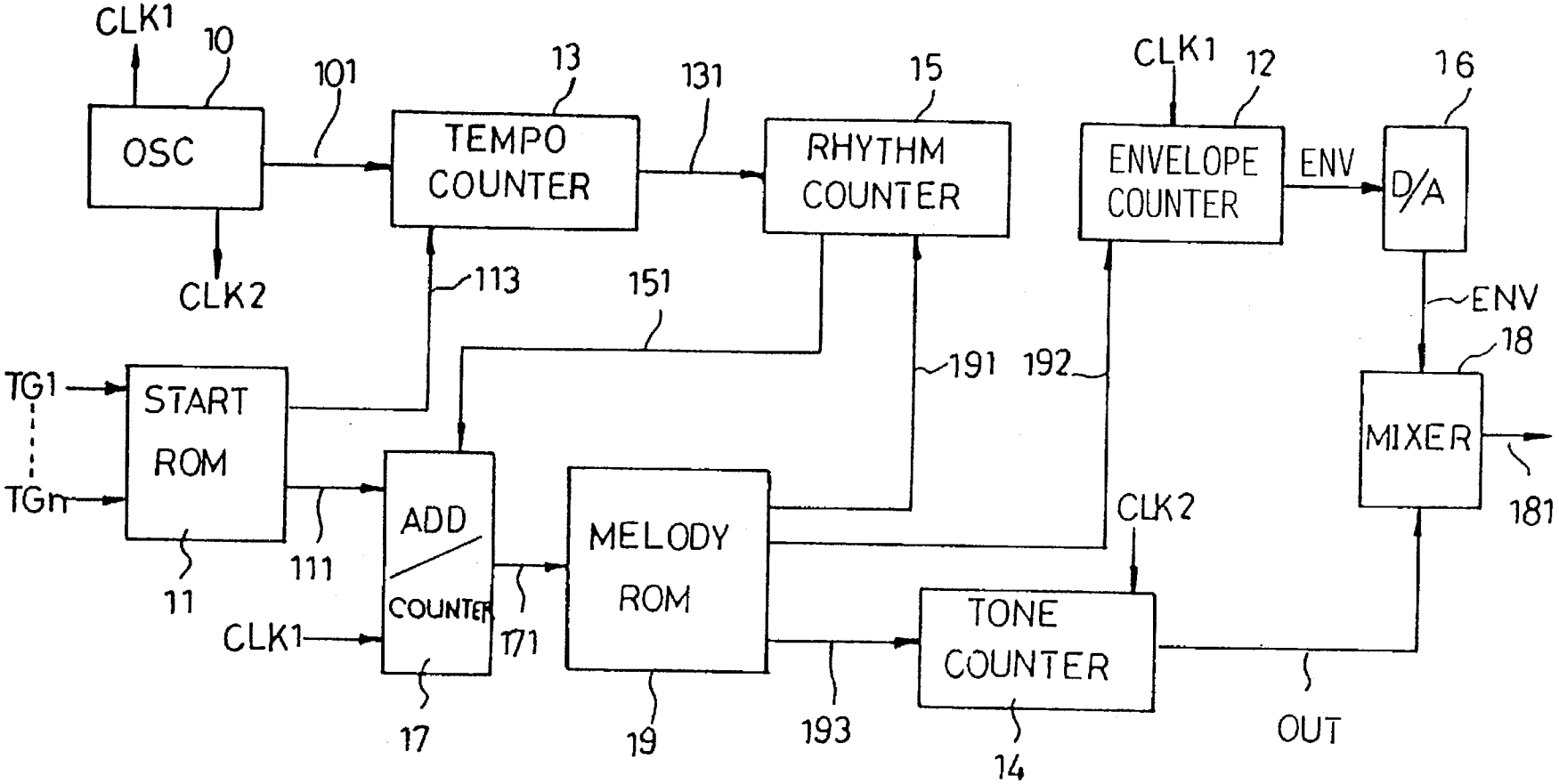
FIG. 1 PRIOR ART
FIG. 1 shows a conventional melody generator.
Figures 2, 3:
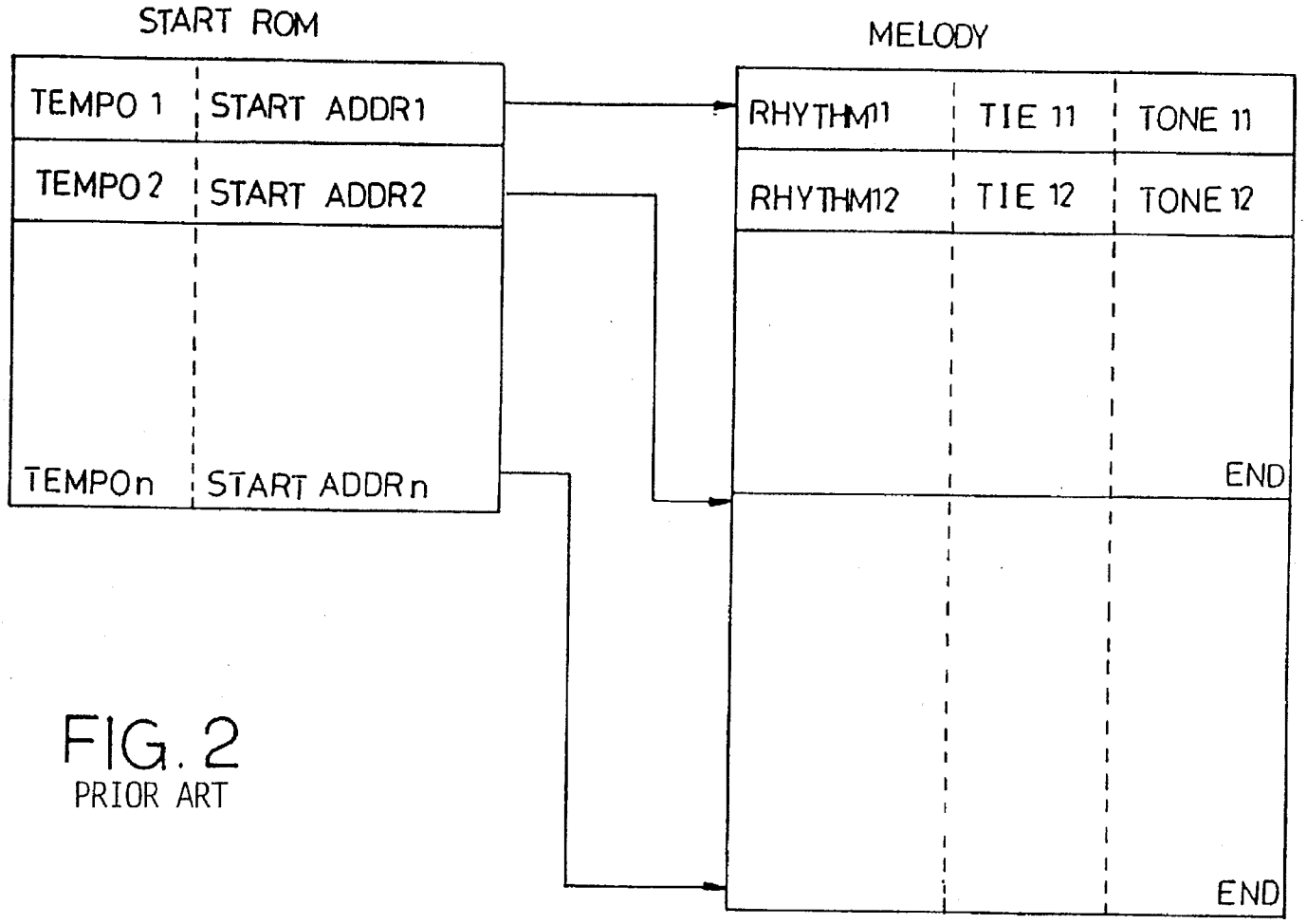
FIG. 2 PRIOR ART
FIG. 3 PRIOR ART
FIG. 2 shows the data structures of the START ROM in FIG. 1.
FIG. 3 shows the data structures of the MELODY ROM in FIG. 1.
Figure 4:
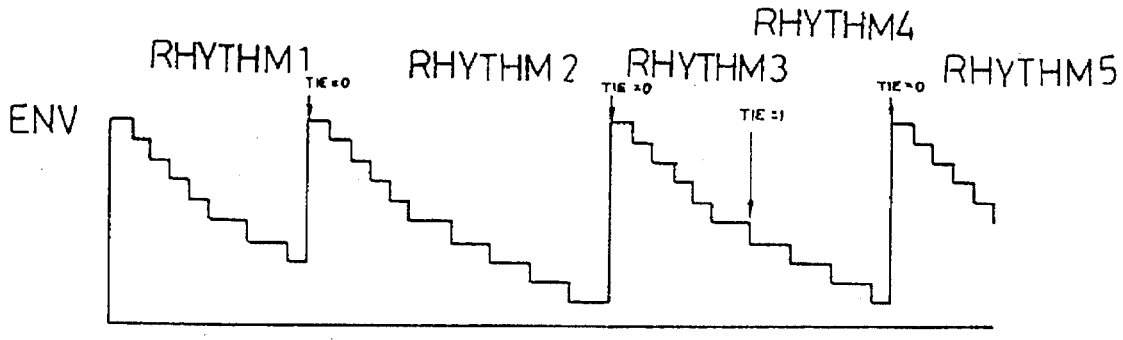
FIG. 4 PRIOR ART
FIG. 4 shows output from the D/A converter 16 of FIG. 1.
Figure 5:
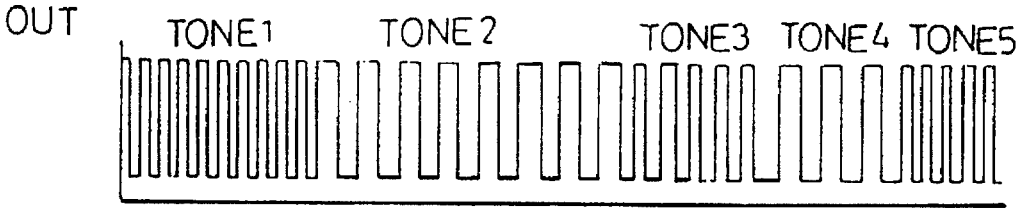
FIG. 5 PRIOR ART
FIG. 5 exemplifies one output signal OUT of the TONE COUNTER.
Figure 6:
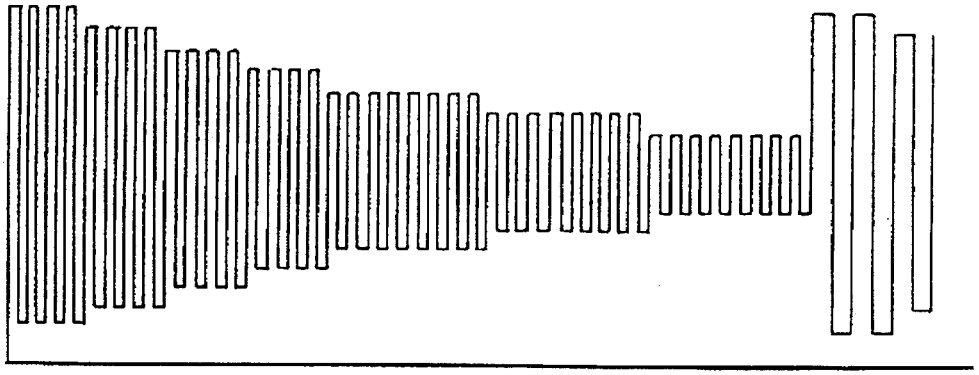
FIG. 6 PRIOR ART
FIG. 6 shows the melody output from MIXER 18 of FIG. 1.
Figure 7:
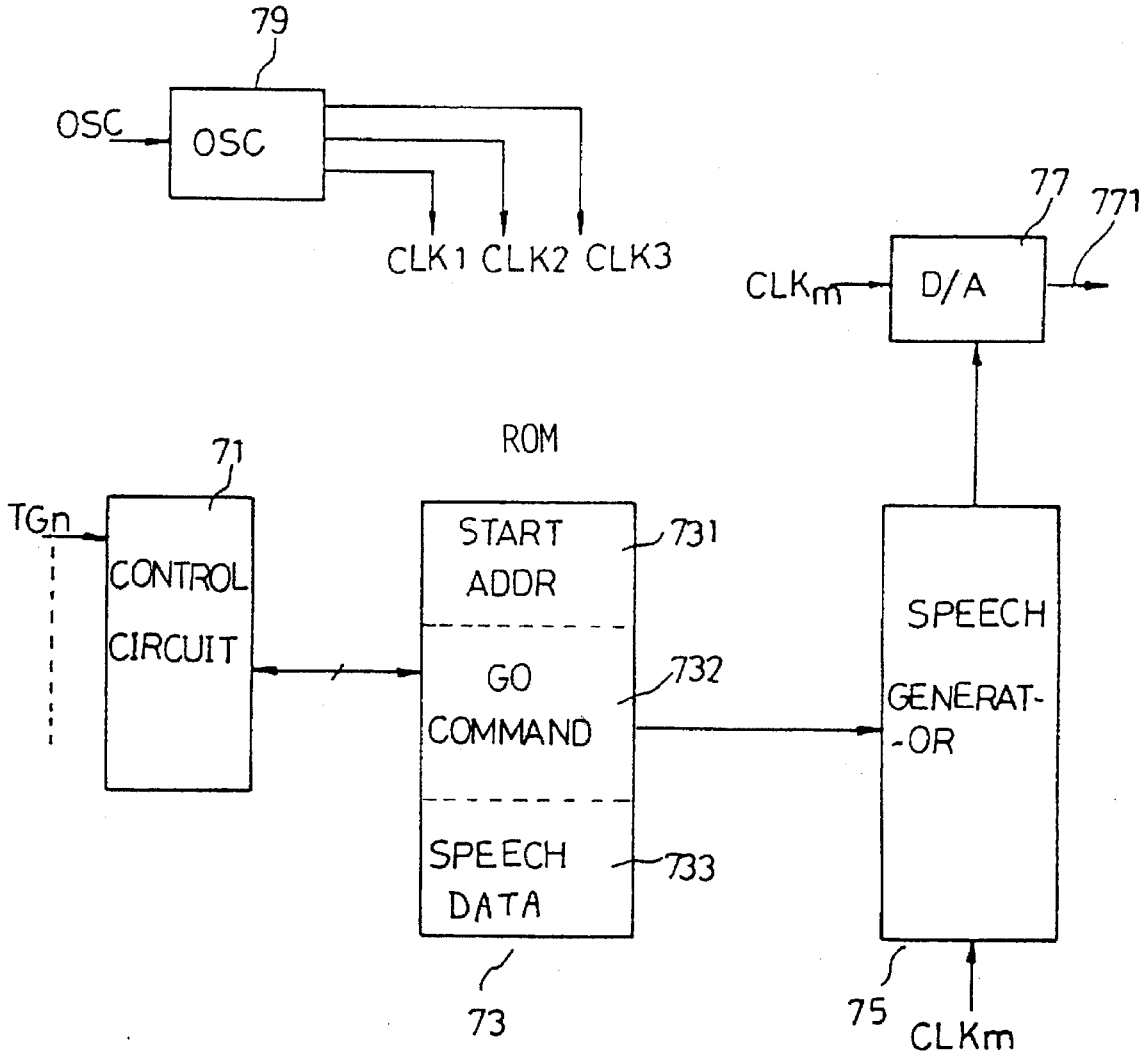
FIG. 7 PRIOR ART
FIG. 7 shows a conventional speech synthesizer.
Figure 8:
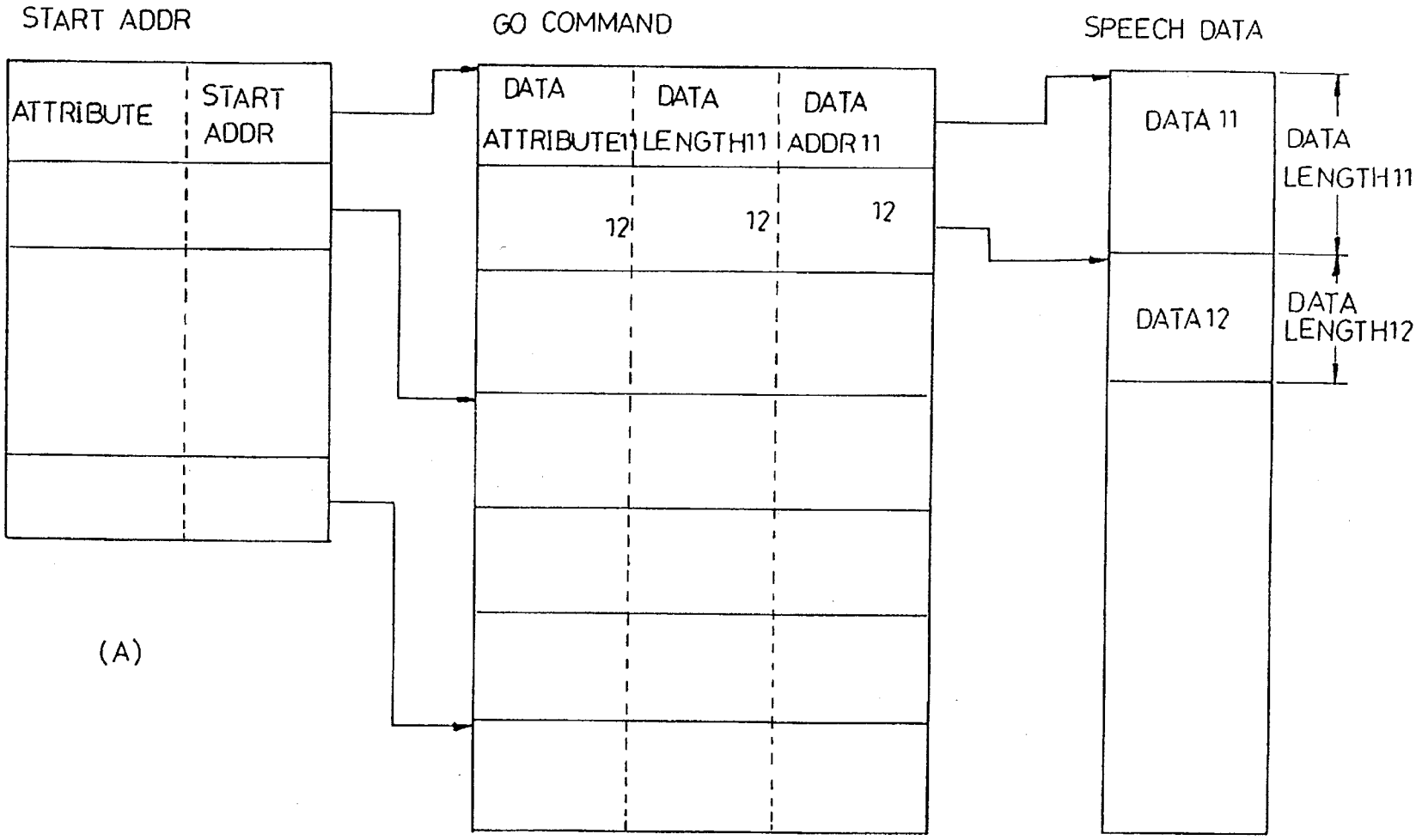
FIG. 8 PRIOR ART
FIG. 8 shows the data structures of the START ROM, GO COMMAND and SPEECH DATA in FIG. 7.
Figure 9:
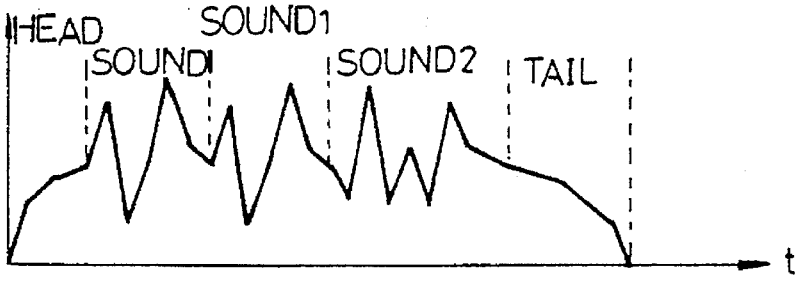
FIG. 9 PRIOR ART
FIG. 9 exemplifies one speech output.
Figure 10:
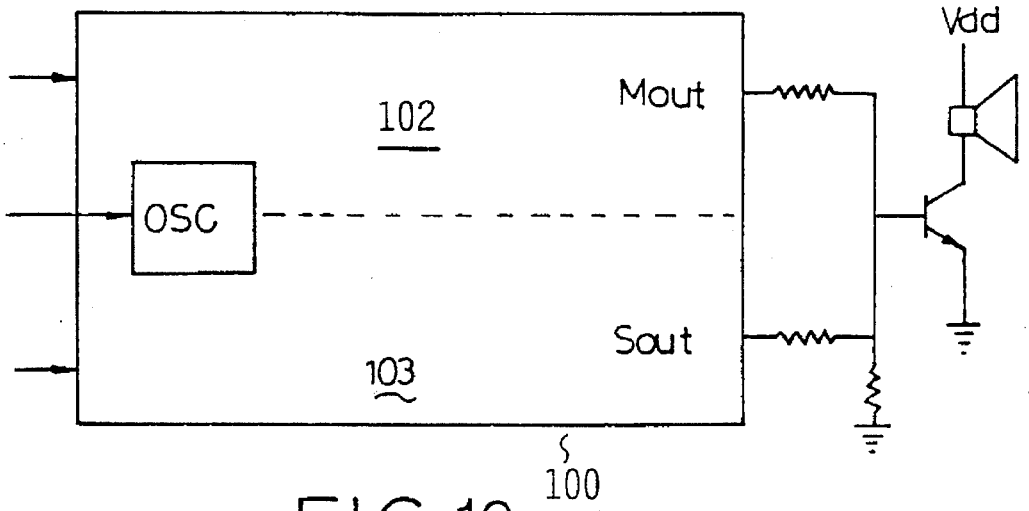
FIG. 10 PRIOR ART
FIG. 10 shows a first conventional approach integrating the speech and melody generator back-to-back.
Figure 11:
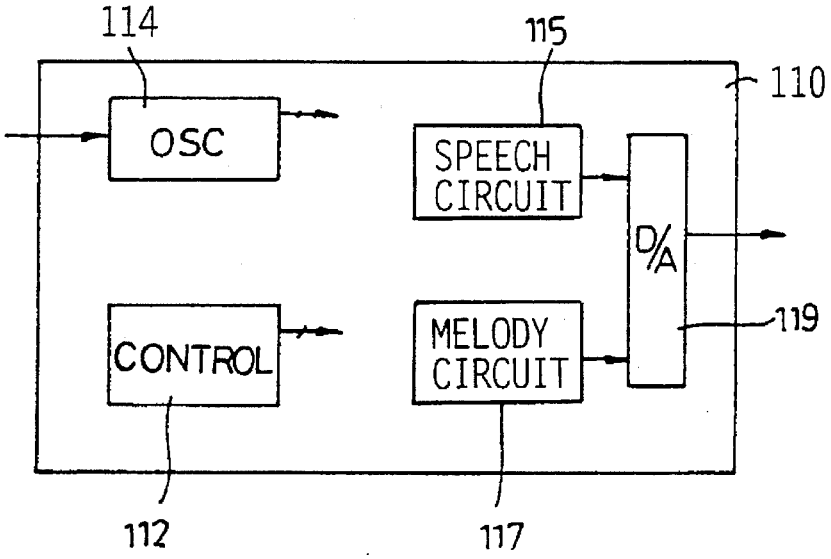
FIG. 11 PRIOR ART
FIG. 11 shows another conventional approach of a speech generator together with a melody generator.
Figure 12:
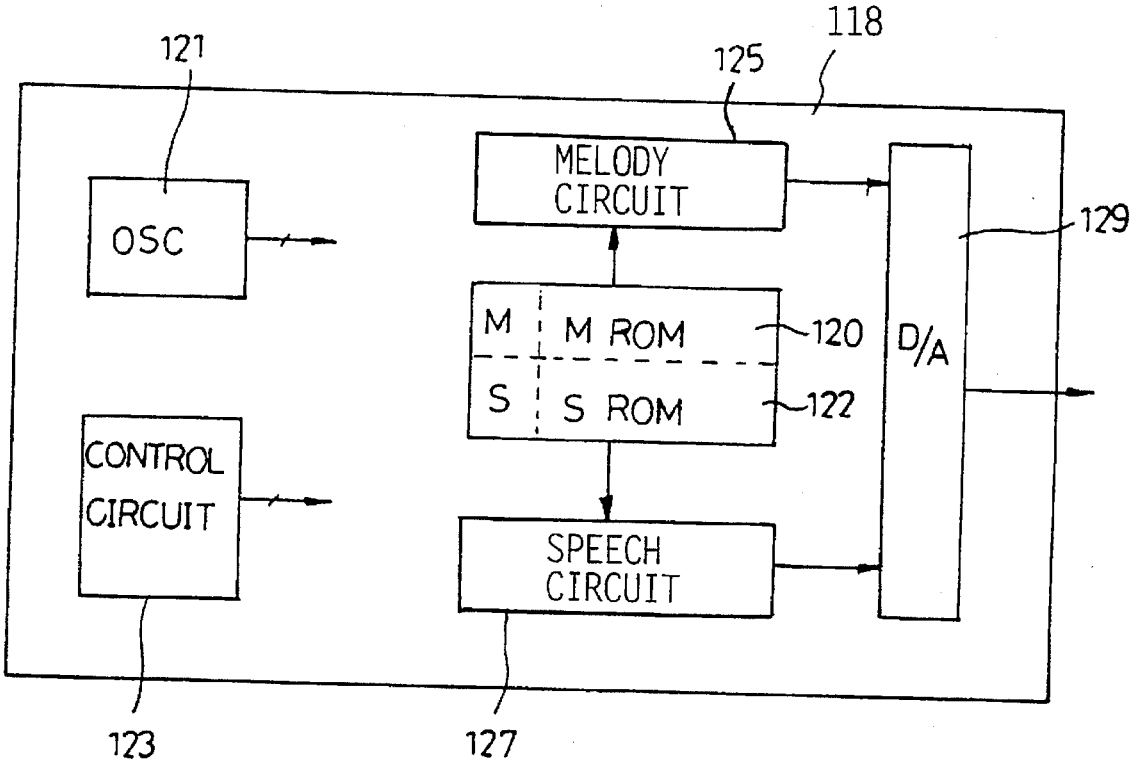
FIG. 12 PRIOR ART
FIG. 12 shows still another conventional approach of a speech generator together with a melody generator.

The START ADDR 141 has the same function as START ROM 11 of FIG. 1, and stores attribute information and the start address of each speech_melody equation selected. GO COMMAND 143 not only stores corresponding data attribute, data length and data address of each accessed basic speech section in the speech_melody equation, but a tone data for each speech section accessed for the purpose of generating melody. The tone data 136 is output to TONE COUNTER 135 to generate the tone control signal 138 which has the shape similar to that shown in FIG. 5. The TONE COUNTER 135, which may be a presettable down-counter or up-counter, acts as a frequency-division device. After the tone data 136 is loaded into the TONE COUNTER 135, the TONE COUNTER 135 up-counts or down-counts until a predetermined value is reached at which time the tone control signal 138 changes state and the tone data 136 is re-loaded. The TONE COUNTER 135 repeats the above operation to generate a waveform corresponding to that tone value until a successive new tone data 136 is accessed and loaded into the TONE COUNTER 135 to generate a waveform corresponding to the new tone data.

The data attributes mentioned above may include conventional speech playback frequency, length of bytes and LED control signals as well as a MELODY attribute, the purposes of which will be recited hereinafter. The SPEECH DATA 145 stores a plurality of sets of data each corresponding to a basic speech element, or basic sound section, and a combination of the sets are used to generate the synthesized speech or melody.

The tone control signal 138 is sent to the control input of the multiplexer (MUX) 130 and varies at a much higher frequency between 0 and 1 than that of the output of speech/melody generator 137. The output from the speech/melody generator 137 or its 1's complement is selectively transmitted to the input of the D/A converter 13A by the tone control signal 138. For instance, when the speech/melody generator 137 outputs a value of 10110011 at one instance, then during this instance the D/A converter 13A interleavingly receives the values 10110011 and 01001100. Therefore, the input of the D/A converter 13A receives a synthesized speech together with a melody of varied frequency corresponding to the tone control signal 138. In an another embodiment, a 2's complement may also be employed.

Figure 15A:
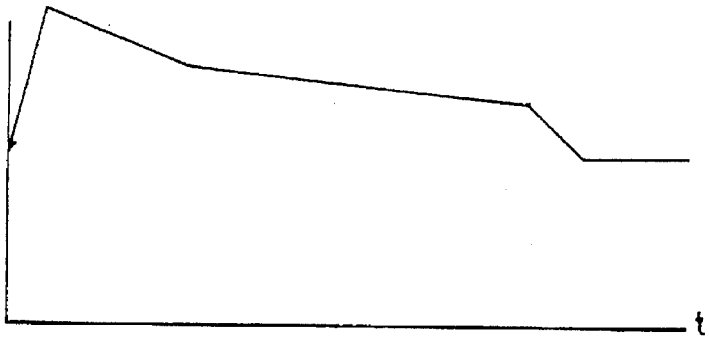
FIGS. 15(A), and 15(B) show the output speech without the melody and with the melody respectively.
Figure 15B:
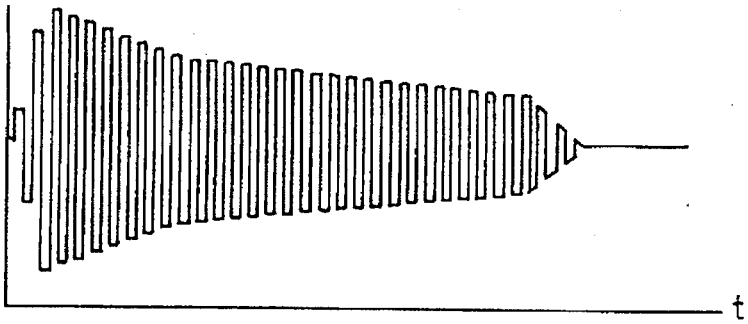

As an example, when the analog form of the speech signal output from the speech/melody generator 137 has the shape shown in FIG. 15(A), the output 13D of the D/A converter 13A takes the shape shown in FIG. 15(B) due to the tone control signal 138 input to the multiplexer 130.

The output generated at the output of the D/A converter 13A may be a pure speech, a pure melody or combination of both in synchronization. The play-back frequency of the data attribute is used to control the speed of the output synthesized speech in a well known manner and, therefore, control the tempo of the melody created. The data length of each accessed speech section is used to control the data points of the speech synthesis and, indirectly, control the rhythm of the note created with the speech. The speech waveform generated is used to control the amplitude of the melody tone, that is, the envelope of the melody. All of the advantages mentioned are possible due to the automatic synchronization between the speech and the melody generated. Furthermore, it is easy to note that a more versatile envelope of the melody may be indirectly created by the waveform of the synthesized speech which is directly created by combination of a plurality of basic speech sections.

Figure 16A:
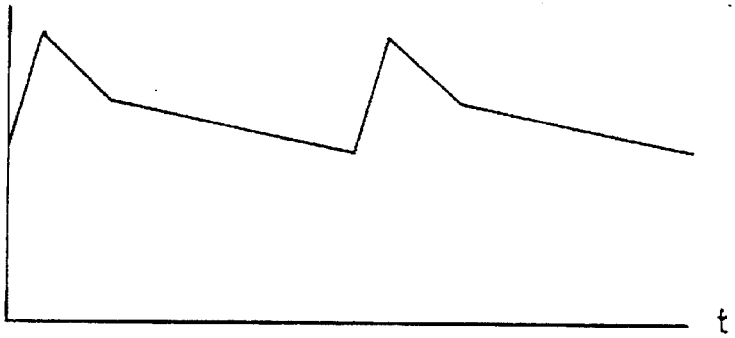
FIGS. 16(A), and 16(B) show the speech output without the melody and with melodies of two different tones respectively.
Figure 16B:
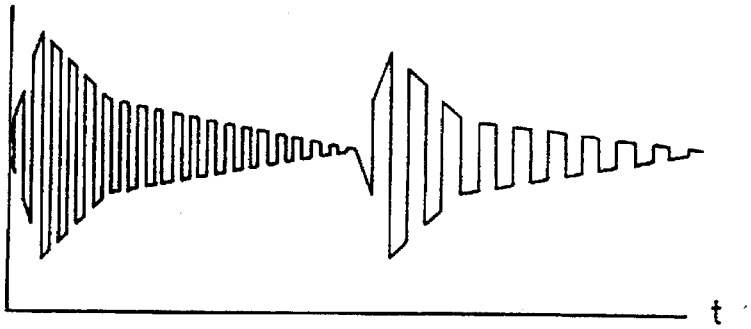

Referring to FIG. 16(A), another example of two consecutive speech outputs are generated by the D/A converter 13A; as the same set of commands as the synthesis in GO COMMAND 143 (FIG. 14B); of the basic speech information. However, in FIG. 16(B), the first mixed output includes the first speech mixed with a melody having a higher tone value while the second speech is mixed with a melody having a lower tone value. The combinations of different tone values; with the same set of commands as the synthesis of the basic speech sections; may be burned into the GO COMMAND ROM segment 143 to meet the needs of different users.

Figure 17:
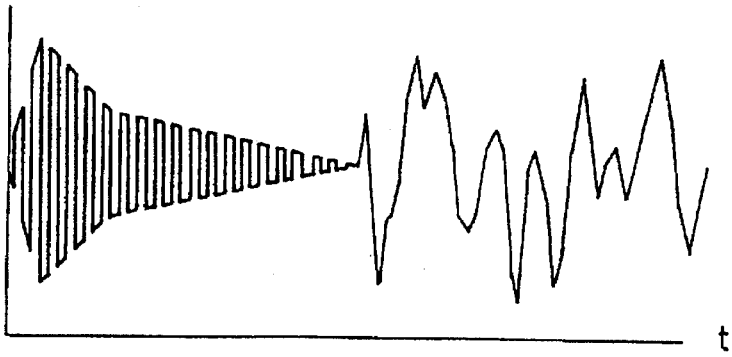
FIG. 17 shows one output with melody and another one without melody.

As shown in FIG. 17, the first output signal is synthesized speech mixed with a melody while the second output signal is synthesized speech not mixed with a melody. The selection to have melody or not to have melody may be achieved easily by the invention. For instance, one bit, designated as MELODY as recited above, of the data attribute in FIG. 14B is reserved for the control of the TONE COUNTER 135. When the MELODY is 1, the TONE COUNTER 135 outputs the control signal 138 to MULTIPLEXER 130 such that melody is created along with the synthesized speech. When MELODY is 0, the output of TONE COUNTER 135 is fixed to a value of 1, or 0, the MULTIPLEXER 130 is then disabled and the synthesized speech is output to the D/A converter 13A directly without creating the melody.

Figure 19:
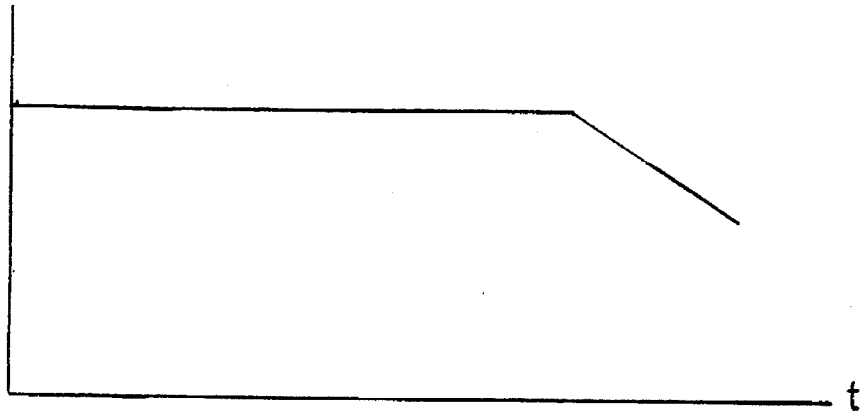
FIG. 19 shows the output of the invention as a silent speech section triggered without melody.
Figure 20:
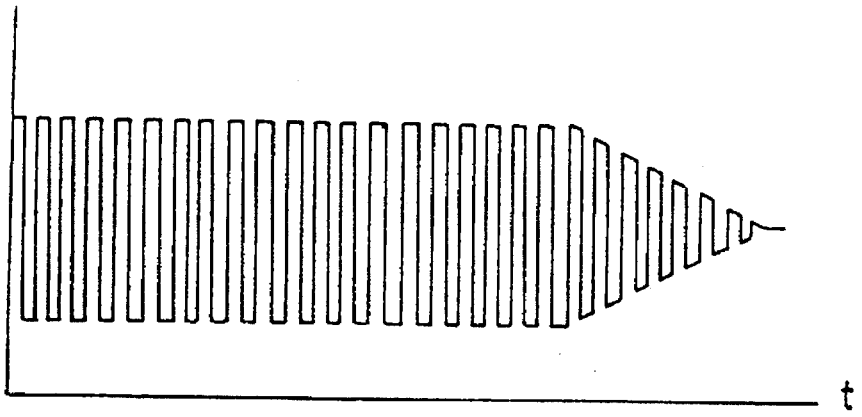
FIG. 20 shows a pure melody output generated by the invention.

In order to generate a pure melody without speech, several solutions may be implemented. For instance, a silence section is provided in the SPEECH DATA 145 which is accessible by a predetermined value of DATA ADDRESS of the GO COMMAND 143. When this silence section is accessed, the output of the D/A converter 13A takes a shape shown in FIG. 19. Via the control of the tone control signal 138, a pure melody output, such as that shown in FIG. 20, of the D/A converter 13A, is therefore generated. However, in a different embodiment, a silent output may be obtained by an address value which does not have corresponding physical memory in a well known manner.

Figure 18:
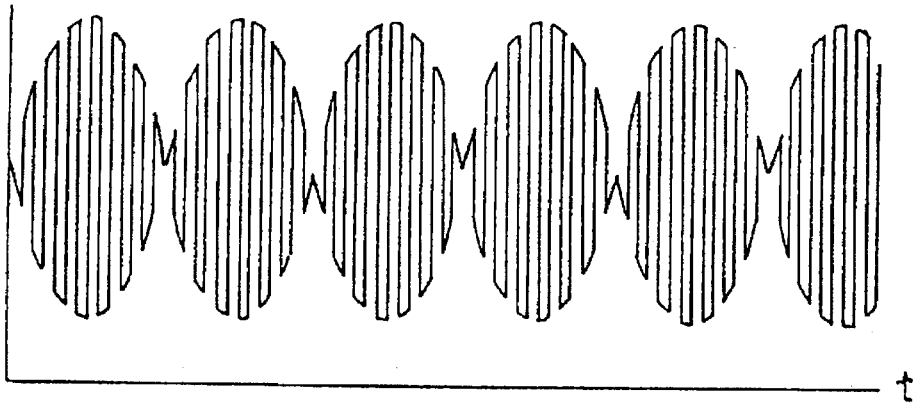
FIG. 18 shows a double tone melody which is created by low tone speech mixing with a high tone melody.

Shown in FIG. 18 of still another example, melody with low frequency (tone) signal may be created or emulated by a synthesized speech signal mixed with a higher frequency melody signal resulting in a dual tone multiple frequency melody.

As an example, as a speech_melody equation of HEAD+2*SOUND1+SOUND2_#D+SOUND1+SOUND3_C+TAIL programmed within the GO COMMAND is triggered, SOUND2 is generated with a melody having tone value of #D and SOUND3 is generated with a melody having tone value of C, while SOUND1 is generated twice without any melody. The denotation #D represents a Re tone in a higher key and denotation C represents a normal Do tone. In other words, the non-existence of the tone value corresponding to an accessed speech section indicates an end of the melody previously generated.

What is claimed is:

1. A synthesizer comprising:

control means for generating a plurality of control signals, and, in response to a trigger code, for generating an address signal, said trigger code corresponding to a sequence of synthesis of a plurality of basic speech sections;

memory means for storing a plurality of sets of data corresponding to said sequence, and, in response to the address signal, for outputing each set of data in sequence, each set of data including a tone data corresponding to each basic speech section;

a tone counter, in response to a clock signal and the tone data, for generating a tone control signal;

speech/melody generator means, receiving the plurality of sets of data from the memory means, and, in response to the control signals from control means and the tone control signal, for providing a synthesized speech or melody mixing with each other in a selective manner.

2. The synthesizer as recited in claim 1, wherein the memory means further comprises:

means for storing data corresponding to each basic speech section used for generating the synthesized speech.

3. The synthesizer as recited in claim 1, wherein the speech/melody generator means comprises:

a speech generator, coupled to the memory means, for generating the synthesized speech;

a selection means, adapted to receive the synthesized speech and a complement value of the synthesized speech, and, in response to the tone control signal, for selectively outputing the synthesized speech and the complement value to an output terminal of the selection means.

4. The synthesizer as recited in claim 1, wherein the memory means stores a data attribute, the tone data, a data length and a data address of each basic speech section at an addressable location.

5. The synthesizer as recited in claim 4, wherein the data attribute includes a value of a playback frequency for controlling a speed of the speech synthesis and a tempo of the melody generated.

6. The synthesizer as recited in claim 4, wherein the data attribute further includes a value of a MELODY for enabling the tone counter and synchronizing the operation of speech synthesis and melody synthesis.

7. The synthesizer as recited in claim 4, wherein the data length is used to control the rhythm of the melody generated.

8. The synthesizer as recited in claim 1, wherein the synthesized speech has a waveform which is also the envelope of the melody generated.

* * * * *